US005951142A

United States Patent [19]

Wang et al.

[11] Patent Number: 5,951,142

[45] Date of Patent: Sep. 14, 1999

[54] ADJUSTABLE ILLUMINATING/RETRIEVING APPARATUS

[76] Inventors: Scott Chien-Kuo Wang; Kuo-Liang Chen, both of No. 8, Puchung 2nd St., Changhua, Taiwan

[21] Appl. No.: 09/093,404

[22] Filed: Jun. 9, 1998

[51] Int. Cl.[6] ..... F21V 33/00

[52] U.S. Cl. ..... 362/109; 362/119; 362/120; 362/398

[58] Field of Search ..... 362/109, 119, 362/188, 202, 198, 253, 285, 287, 288, 277, 282, 319, 322, 427, 120, 398; 294/65.5

[56] References Cited

U.S. PATENT DOCUMENTS

| | | | |
|---|---|---|---|
| 3,582,638 | 6/1971 | Peters | 294/65.5 |
| 4,819,137 | 4/1989 | Hamilton | 362/102 |
| 5,381,319 | 1/1995 | Shiao | 362/120 |

*Primary Examiner*—Thomas M. Sember
*Attorney, Agent, or Firm*—Rosenberg, Klein & Bilker

[57] ABSTRACT

An adjustable illuminating/retrieving apparatus comprising a flexible structure having a first end portion and a second end portion connected with a first end portion of an extension tube which includes a second end portion with a magnet fixedly mounted therein. A supporting base extends outward from the first end portion of the extension tube and is pivotally connected with a pivot base. A receiving tube includes a first end portion mounted on the pivot base and a second end portion formed with a first annular flange extending outward. A lighting unit is received in the receiving tube and partially extends outward of the second end portion of the receiving tube. A sliding sleeve is slidably mounted on the receiving tube and includes a first end portion formed with a second annular flange extending inward. The sliding sleeve is able to slide between a first position where the second annular flange abuts the first annular flange such that the sliding sleeve fully encompasses the lighting unit such that the lighting unit emits light in a convergent manner, and a second position where the sliding sleeve is retracted on the receiving tube, thereby exposing the lighting unit outward of the receiving tube such that the lighting unit emits light in a divergent manner.

8 Claims, 6 Drawing Sheets

ADJUSTABLE ILLUMINATING/RETRIEVING APPARATUS

FIELD OF THE INVENTION

The present invention relates to an adjustable illuminating/retrieving apparatus.

BACKGROUND OF THE INVENTION

A conventional illuminating/retrieving apparatus is shown in FIG. 6, and there will be a complete illustration in the detailed description of the preferred embodiments, concerning the conventional illuminating/retrieving apparatus. The present invention has arisen to mitigate and/or obviate the disadvantage of the conventional illuminating/retrieving apparatus.

SUMMARY OF THE INVENTION

In accordance with one aspect of the present invention, there is provided an adjustable illuminating/retrieving apparatus comprising an elongated flexible structure including a first end portion and a second end portion. An elongated extension tube includes a first end portion fixedly mounted on the second end portion of the flexible structure and a second end portion, with a magnet fixedly mounted in the second end portion of the extension tube.

A supporting base extends outward from an outer periphery of the first end portion of the extension tube, and a pivot base is pivotally secured to the supporting base. A receiving tube includes a first end portion fixedly mounted on the pivot base and a second end portion formed with a first annular flange extending radially outward. A lighting unit is fixedly received in the receiving tube and partially extends outward from the second end portion of the receiving tube. A sliding sleeve is slidably mounted on the receiving tube and includes a first end portion formed with a second annular flange extending radially and inward and a second end portion located adjacent to the second end portion of the receiving tube.

By such an arrangement, the sliding sleeve is able to slide between a first position where the second annular flange abuts the first annular flange such that the sliding sleeve fully encompasses the lighting unit such that the lighting unit emits light in a convergent manner, and a second position where the sliding sleeve is retracted on the receiving tube, thereby exposing the lighting unit outward of the receiving tube such that the lighting unit emits light in a divergent manner.

Further benefits and advantages of the present invention will become apparent after a careful reading of the detailed description with appropriate reference to the accompanying drawings.

DETAILED DESCRIPTION OF THE PREFERRED EMBODIMENTS

Figure 6:
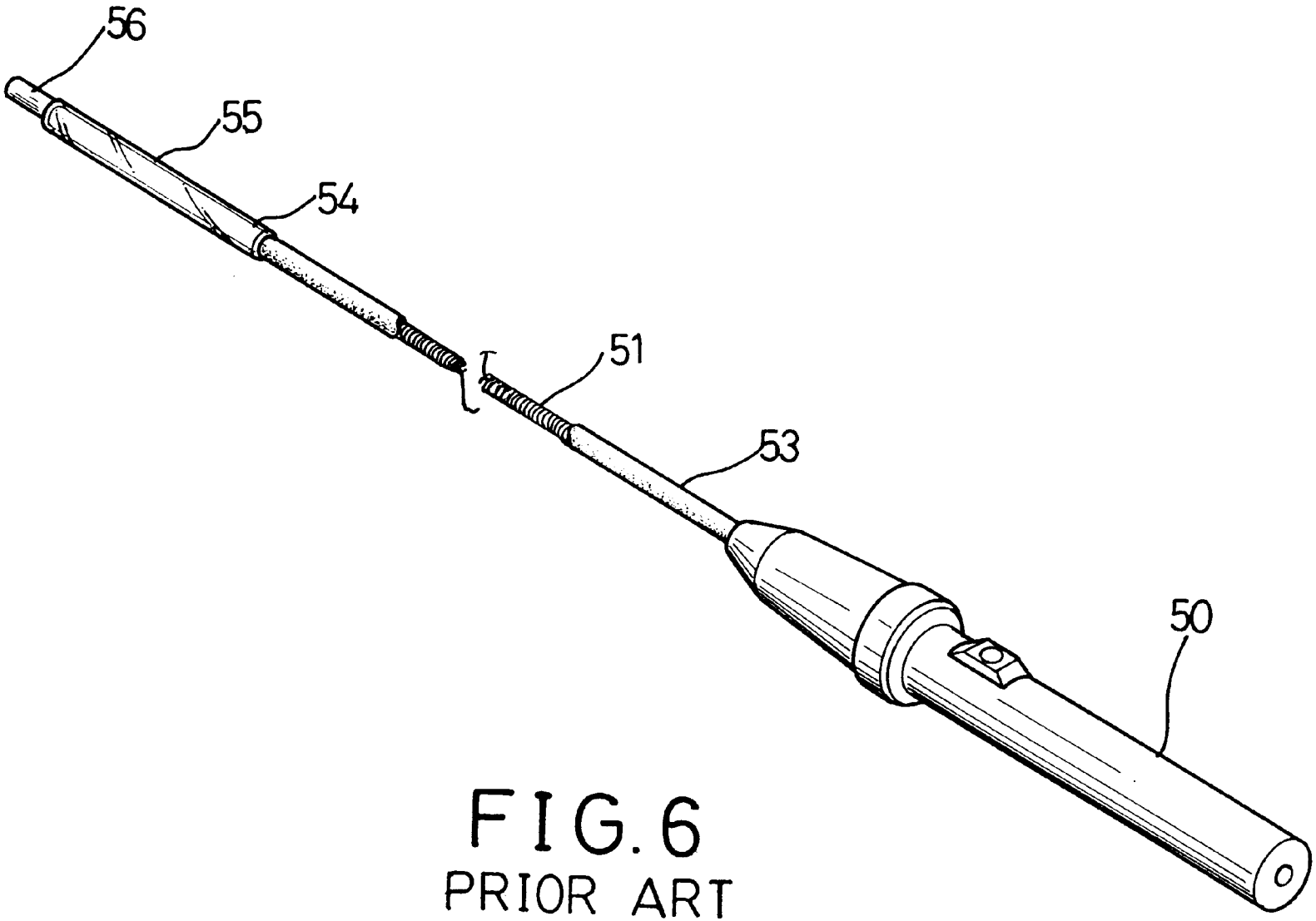
FIG. 6 PRIOR ART
FIG. 6 is a partially cut-away perspective view of a conventional illuminating/retrieving apparatus in accordance with the prior art.

For a better understanding of the present invention, reference is made to FIG. 6 illustrating a conventional illuminating/retrieving apparatus in accordance with the prior art.

The conventional illuminating/retrieving apparatus comprises a receiving cylinder 50 for receiving batteries (not shown) therein, a flexible spring coil 51 including a first end portion connected to the cylinder 50 and a second end portion connected to a lighting unit 54, a cover 53 coated on the spring coil 51, a transparent tube 55 mounted on the lighting unit 54, and a magnet 56 fitted on a front end of the transparent tube 55 for retrieving objects. The conventional illuminating/retrieving apparatus can be used in a deeply located space such as an engine chamber of a car for providing an illumination function by means of the lighting unit 54 and providing a retrieving function by means of the magnet 56 for retrieving small metallic parts in the engine chamber.

By such an arrangement, however, the magnet 56 located in front of the transparent tube 55 tends to obstruct the light emitted from the lighting unit 54, thereby easily causing inefficient illumination such that a user cannot observe parts located in front of the magnet 56. In addition, the lighting unit 54 cannot be adapted to illuminate divergent positions deeply located in the engine chamber.

Figure 1:
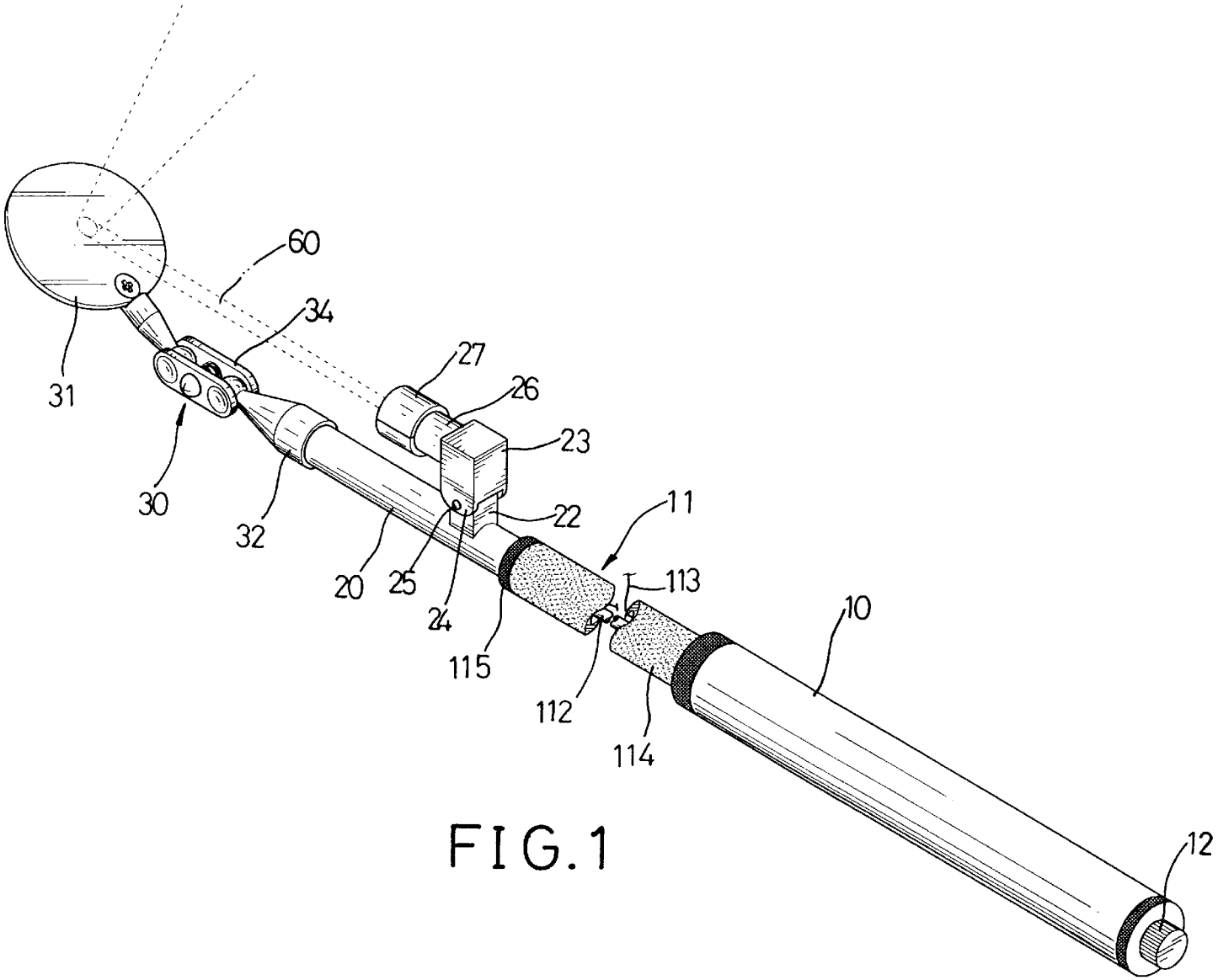
FIG. 1 is a partially cut-away perspective view of an adjustable illuminating/retrieving apparatus in accordance with the present invention.
Figure 2:
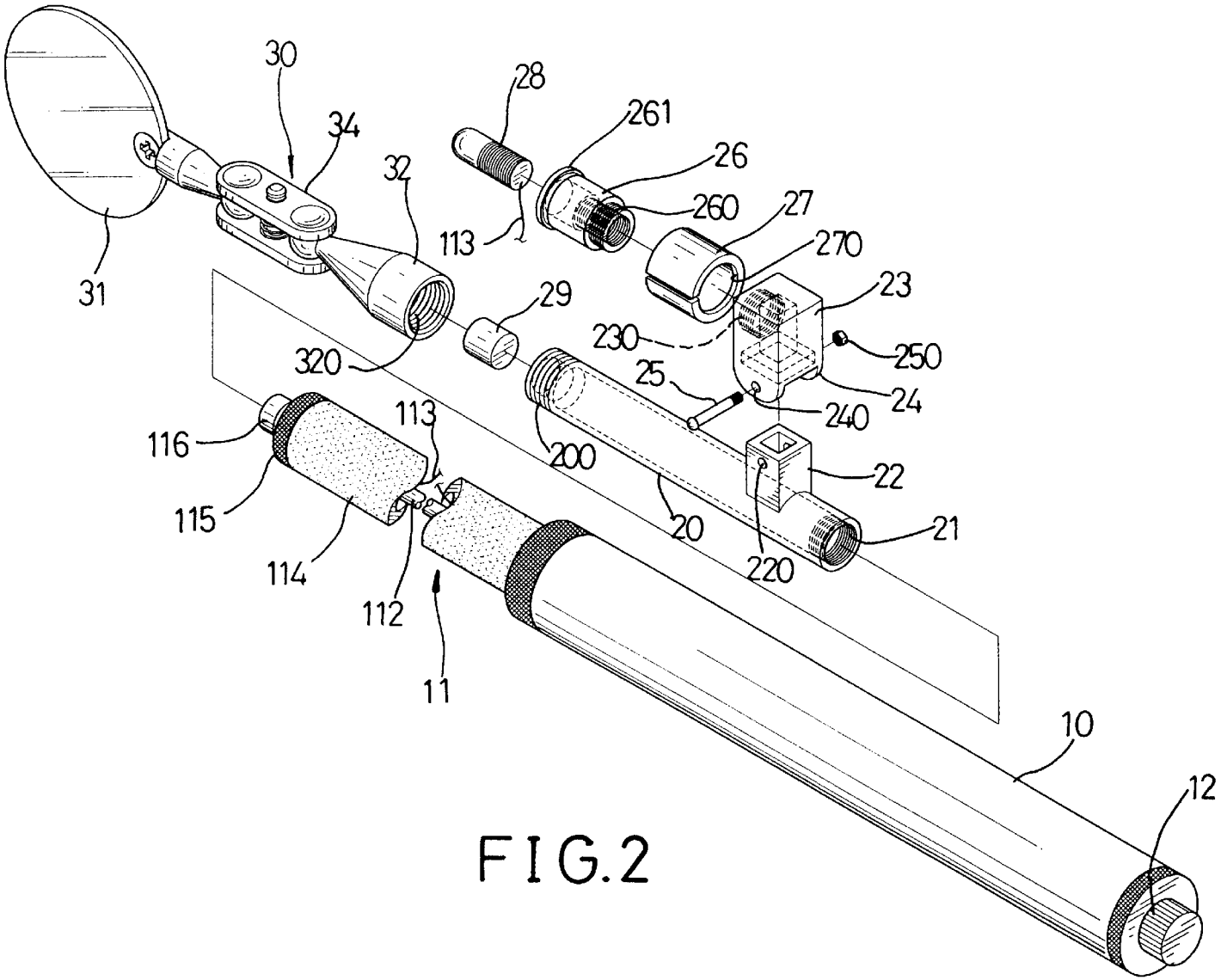
FIG. 2 is a partially cut-away exploded view of the adjustable illuminating/retrieving apparatus as shown in FIG. 1.
Figure 3:
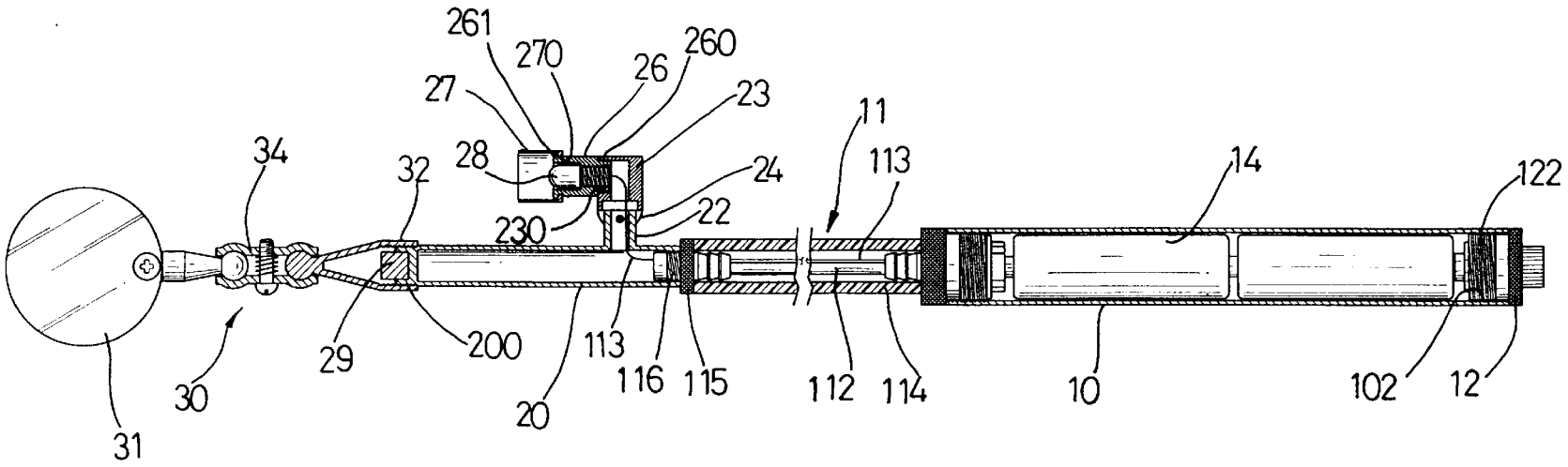
FIG. 3 is a front plan partially cross-sectional assembly view of the adjustable illuminating/retrieving apparatus as shown in FIG. 2.

Referring now to FIGS. 1–3, an adjustable illuminating/retrieving apparatus according to the present invention comprises a receiving cylinder 10 including a first end portion and a second end portion, an elongated flexible structure 11 including a first end portion fixedly connected with the second end portion of the receiving cylinder 10 and a second end portion. An elongated extension tube 20 includes a first end portion fixedly mounted on the second end portion of the flexible structure 11 and a second end portion in which a magnet 29 is fixedly mounted.

A hollow supporting base 22 extends outward from an outer periphery of the first end portion of the extension tube 20, and a hollow pivot base 23 is pivotally secured to the supporting base 22. The supporting base 22 includes two side walls each containing a first transverse hole 220 therein, the pivot base 23 includes two ears 24 each extending downward and each containing a second transverse hole 240 aligning with the first transverse hole 220, a positioning bolt 25 extends through the second transverse hole 240 and the first transverse hole 220, and an engaging nut 250 is threaded onto the positioning bolt 25 such that the pivot base 23 can be pivotally secured to the supporting base 22.

A receiving tube 26 includes a first end portion fixedly mounted on the pivot base 23 and a second end portion formed with a first annular flange 261 extending radially and outward. The pivot base 23 includes a side wall containing a transverse threaded bore 230 therein, and the receiving tube 26 includes an outer thread 260 formed on the first end portion thereof and threaded into the threaded bore 230 such that the receiving tube 26 can be screwed to the pivot base 23.

A lighting unit 28 is fixedly received in the receiving tube 26 and partially extends outward of the second end portion of the receiving tube 26. A C-shaped sliding sleeve 27 is slidably mounted on the receiving tube 26 and includes a first end portion formed with a second annular flange 270 extending radially and inward and a second end portion located adjacent to the second end portion of the receiving tube 26.

Two batteries 14 are received in the receiving cylinder 10 for supplying electricity to the lighting unit 28. A rotary knob 12 is rotatably mounted on the first end portion of the receiving cylinder 10 and includes a threaded column 122 threaded in an inner thread 102 formed on the first end portion of the receiving cylinder 10 so as to press or release the batteries 14 by means of rotating the rotary knob 12.

The flexible structure 11 further comprises a hose 114 including a first end portion connected with the second end portion of the receiving cylinder 10 and a second end portion connected with the first end portion of the extension tube 20, a flexible iron wire 112 including a first end portion connected to one of the two batteries 14 and a second end portion electrically connected to the lighting unit 28, and a conducting wire 113 including a first end portion connected to one of the two batteries 14 and a second end portion connected to the lighting unit 28. Preferably, the conducting wire 113 is coated with an insulating covering layer.

The extension tube 20 contains an inner thread 21 in the first end portion thereof, and the flexible structure 11 further comprises a hollow connecting block 115 fixedly mounted on the second end portion of the hose 114, and a threaded post 116 integrally formed on the connecting block 115 and threaded in the inner thread 21 of the extension tube 20 such that the extension tube 20 can be threaded to the connecting block 115 of the flexible structure 11.

The lighting unit 28 includes one end portion connected to the second end portion of the conducting wire 113 whose first end portion is connected to one of the two batteries 14, and an outer periphery electrically connected to the receiving tube 26 made of metallic material which is electrically connected to the pivot base 23 made of metallic material which is electrically connected to the supporting base 22 of the extension tube 20 made of metallic material which is electrically connected to the threaded post 116 made of metallic material which is electrically connected to the second end portion of the iron wire 112 whose first end portion is connected to one of the two batteries 14, thereby forming a complete circuit such that the batteries 14 can supply electricity to the lighting unit 28.

An angle adjusting device 30 includes a coupling 32 fixedly mounted on the second end portion of the extension tube 20, a pivot bracket 34 including a first end portion pivotally connected with the coupling 32 and a second end portion pivotally connected with a reflecting mirror 31 for reflecting a beam of light emitting from the lighting unit 28 so as to adjust the reflecting angle of the beam of light. The coupling 32 includes an inner thread 320, and the extension tube 20 includes an outer thread 200 formed on the second end portion thereof and threaded into the inner thread 320 such that the angle adjusting device 30 can be threaded to the extension tube 20. Preferably, the pivot bracket 34 can be pivoted relative to the extension tube 20 and can also be rotated relative to the extension tube 20 from a position as shown in FIG. 2 to a position as shown in FIG. 1.

Figure 4:
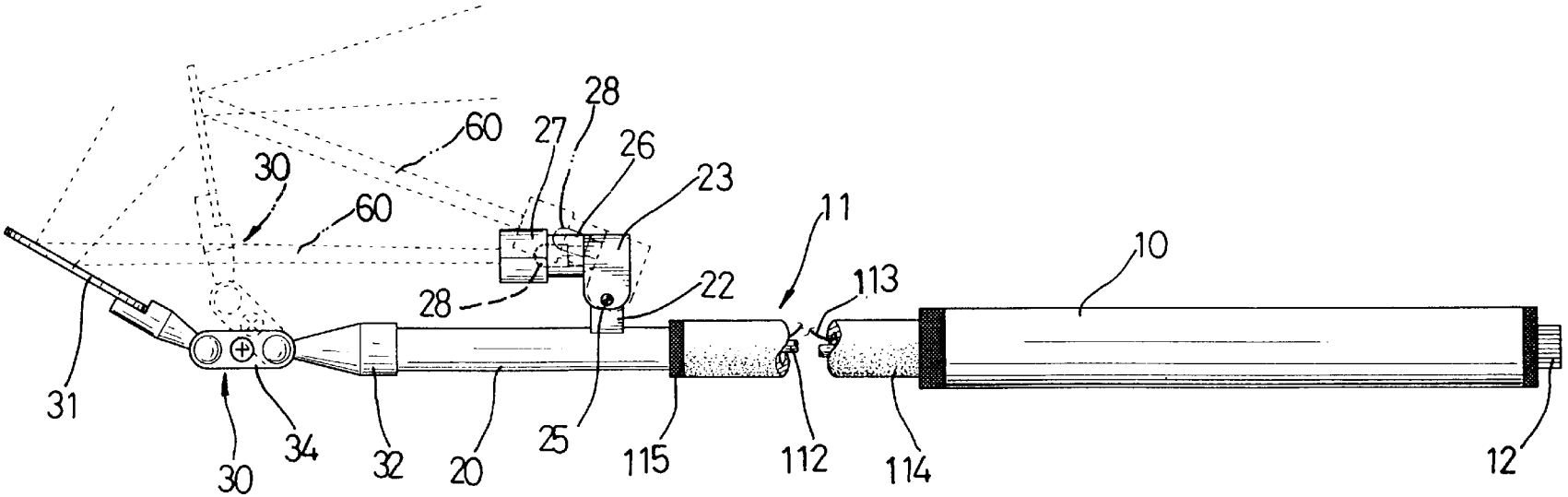
FIG. 4 is an operational view of the adjustable illuminating/retrieving apparatus as shown in FIG. 3.
Figure 5:
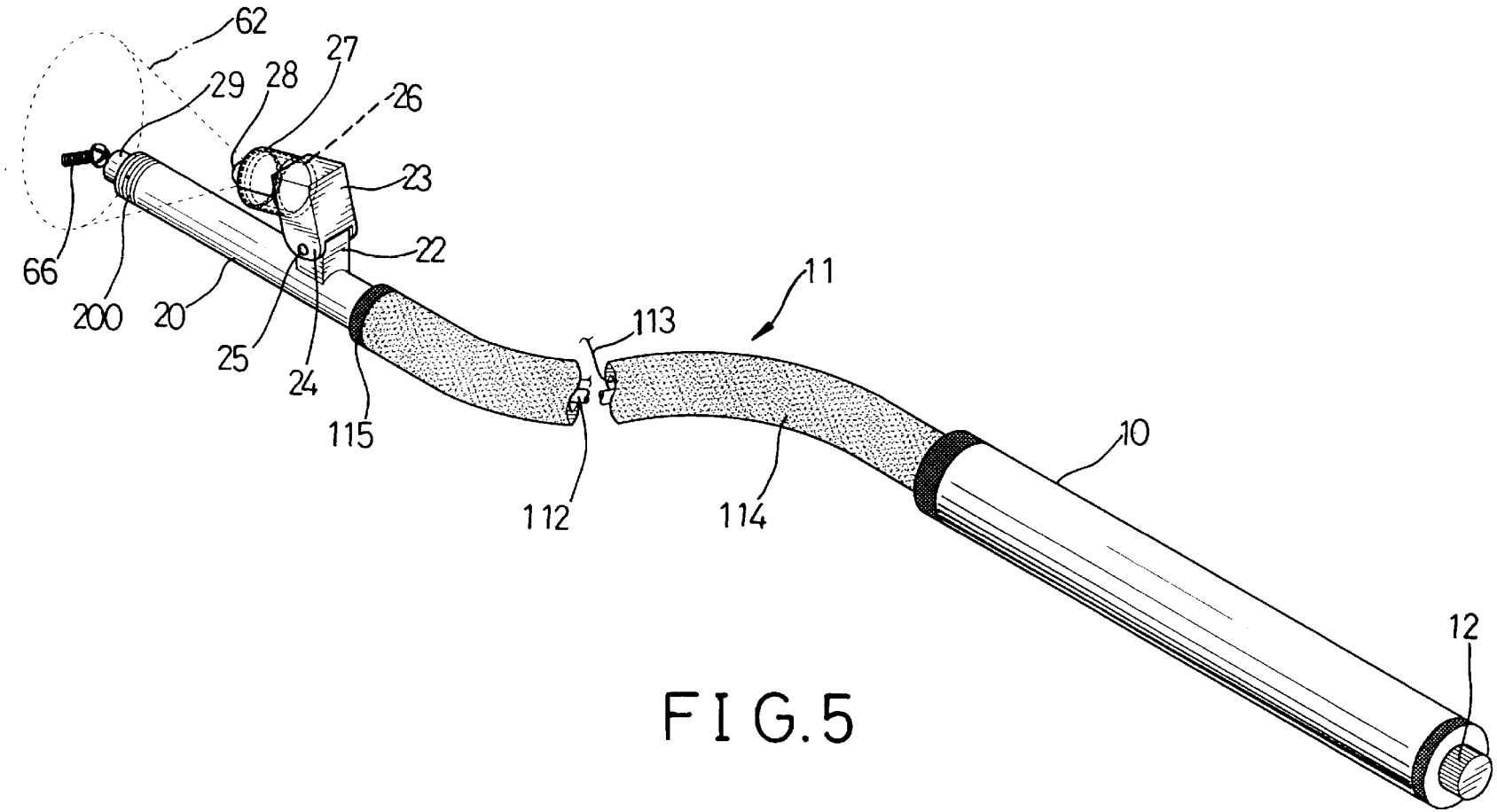
FIG. 5 is an operational view of the adjustable illuminating/retrieving apparatus as shown in FIG. 1.

In operation, referring now to FIGS. 3–5 with reference to FIGS. 1 and 2, the sliding sleeve 27 is able to slide to a first position as shown in FIGS. 3 and 4 where the second annular flange 270 of the sliding sleeve 27 abuts the first annular flange 261 of the receiving tube 26 such that the sliding sleeve 27 fully encompasses the lighting unit 28 such that the lighting unit 28 emits a beam of light 60 in a convergent manner as shown in FIG. 1 such that the illuminating/retrieving apparatus can be adapted to be used in a deeply located space such as an engine chamber of an automobile for providing illuminating function.

Especially referring to FIG. 4, the reflecting mirror 31 can be used to reflect the beam of light 60 such that the direction of travel of the beam of light 60 can be adjusted. In addition, the pivot bracket 34 can be pivoted relative to the extension tube 20 and the pivot base 23 can be pivoted relative to the supporting base 22 from a first position as shown in solid lines to a second position as shown in phantom lines respectively such that the direction of travel and angle of projection of the beam of light 60 can be arbitrarily adjusted such that the beam of light 60 can be projected to any bending portion of the engine chamber.

Especially referring now to FIG. 5, the angle adjusting device 30 can be removed from the extension tube 20, thereby exposing the magnet 29, and the flexible structure 11 can be bent in a suitable manner. The sliding sleeve 27 is able to slide to a second position where the sliding sleeve 27 is filly retracted on the receiving tube 26, thereby exposing the lighting unit 28 outward of the receiving tube 26 such that the lighting unit 28 emits light 62 in a divergent manner. In such a manner, the light 62 can be projected onto a large area as shown in phantom lines, thereby adjustable illuminating a small metallic part such as a screw 66 which can then be retrieved by the magnet 29.

It should be clear to those skilled in the art that further embodiments may be made without departing from the scope and spirit of the present invention.

What is claimed is:

1. An adjustable illuminating/retrieving apparatus comprising:

an elongated flexible structure (11) including a first end portion and a second end portion;

an elongated extension tube (20) including a first end portion fixedly mounted on said second end portion of said flexible structure (11) and a second end portion;

a magnet (29) fixedly mounted in said second end portion of said extension tube (20);

a supporting base (22) extending outward from an outer periphery of said first end portion of said extension tube (20);

a pivot base (23) pivotally secured to said supporting base (22);

a receiving tube (26) including a first end portion fixedly mounted on said pivot base (23) and a second end portion formed with a first annular flange (261) extending radially outward;

a lighting unit (28) fixedly received in said receiving tube (26) and partially extending outward of said second end portion of said receiving tube (26);

a sliding sleeve (27) slidably mounted on said receiving tube (26) and including a first end portion formed with a second annular flange (270) extending radially and inward and a second end portion located adjacent to said second end portion of said receiving tube (26), wherein said sliding sleeve (27) is able to slide between a first position where said second annular flange (270) abuts said first annular flange (261) such that said sliding sleeve (27) fully encompasses said lighting unit (28) such that said lighting unit (28) emits light in a convergent manner, and a second position where said sliding sleeve (27) is retracted on said receiving tube (26), thereby exposing said lighting unit (28) outward of said receiving tube (26) such that said lighting unit (28) emits light in a divergent manner.

2. The adjustable illuminating/retrieving apparatus according to claim 1, further comprising a receiving cylinder (10) including a first end portion and a second end portion fixedly connected with said first end portion of said flexible structure (11), and at least one battery (14) received in said receiving cylinder (10) for supplying electricity to said lighting unit (28).

3. The adjustable illuminating/retrieving apparatus according to claim 2, wherein said flexible structure (11) further comprises a hose (114) including a first end portion connected with said second end portion of said receiving cylinder (10) and a second end portion connected with said first end portion of said extension tube (20), a flexible iron wire (112) electrically connected between said battery (14) and said lighting unit (28), and a conducting wire (113) including a first end portion connected to said battery (14) and a second end portion connected to said lighting unit (28).

4. The adjustable illuminating/retrieving apparatus according to claim 3, wherein said extension tube (20) contains an inner thread (21) in the first end portion thereof, and said flexible structure (11) further comprises a hollow connecting block (115) fixedly mounted on said second end portion of said hose (114), and a threaded post (116) integrally formed on said connecting block (115) and threaded in said inner thread (21) of said extension tube (20).

5. The adjustable illuminating/retrieving apparatus according to claim 1, wherein said supporting base (22) includes two side walls each containing a first transverse hole (220), said pivot base (23) includes two ears (24) each extending downward and each containing a second transverse hole (240) aligning with said first transverse hole (220), and said adjustable illuminating/retrieving apparatus further comprises a positioning bolt (25) extending through said second transverse hole (240) and said first transverse hole (220), and an engaging nut (250) threadedly engaged on said positioning bolt (25).

6. The adjustable illuminating/retrieving apparatus according to claim 1, further comprising an angle adjusting device (30) including a coupling (32) fixedly mounted on said second end portion of said extension tube (20), and a mirror (31) pivotally connected with said coupling (32).

7. The adjustable illuminating/retrieving apparatus according to claim 6, wherein said angle adjusting device (30) further comprises a pivot bracket (34) including a first end portion pivotally connected with said coupling (32) and a second end portion pivotally connected with said mirror (31).

8. The adjustable illuminating/retrieving apparatus according to claim 6, wherein said coupling (32) includes an inner thread (320), and said extension tube (20) includes an outer thread (200) formed on the second end portion thereof and threaded into said inner thread (320).

* * * * *